United States Patent [19]

Cooper

[11] 4,135,681

[45] Jan. 23, 1979

[54] WINCH ATTACHMENT FOR VEHICLE WHEELS

[76] Inventor: Wayne F. Cooper, 15806 Tepee Dr., Fountain Hills, Ariz. 85268

[21] Appl. No.: 872,927

[22] Filed: Jan. 27, 1978

[51] Int. Cl.[2] ..... B66D 3/00

[52] U.S. Cl. ..... 242/95; 254/166

[58] Field of Search ..... 242/95, 54 R; 254/166, 254/150 R

[56] References Cited

U.S. PATENT DOCUMENTS

| | | | |
|---|---|---|---|
| 1,165,510 | 12/1915 | James et al. | 242/95 |
| 1,526,206 | 2/1925 | Dominguez, Jr. | 242/95 |
| 3,099,416 | 7/1963 | Wright | 242/95 |
| 3,132,823 | 5/1964 | Domines | 242/95 |

*Primary Examiner*—George F. Mautz

*Attorney, Agent, or Firm*—LaValle D.. Ptak

[57] ABSTRACT

A winch is constructed to be removably attached to the driving wheel of a motor vehicle by means of the lug bolts of the vehicle. The winch comprises a hollow drum with flanges on each end. The inner one of the flanges has holes through it to receive the lug bolts of the vehicle wheel, and the drum has holes formed through it directly opposite each of the lug bolt receiving holes on this flange to accommodate the head of a wrench for tightening and loosening the lug bolts. The outer flange has holes through it aligned with the lug bolt receiving holes of the inner flange, so that the wrench can pass through these holes in the outer flange for attaching and removing the winch to and from the vehicle wheel. The outer flange also has an additional hole formed in it to facilitate the attachement of a cable or rope for use with the winch.

10 Claims, 7 Drawing Figures

WINCH ATTACHMENT FOR VEHICLE WHEELS

BACKGROUND OF THE INVENTION

Frequently the driving wheels of a motor vehicle become stuck in mud, sand or snow in the operation of the vehicle; so that the necessary traction for moving the vehicle either forward or backward cannot be developed by the stuck driving wheel. This is true of four-wheel drive vehicles and vehicles with positive traction differentials as well as conventional motor vehicles. Such situations frequently arise in areas having heavy snow or with four-wheel drive vehicles which are driven into remote areas where they frequently encounter deep mud or sand. Usually when a motor vehicle becomes stuck, it must be dug out of the snow, mud or sand which is a long and arduous task. Frequently, the vehicle cannot be dug out, and it is necessary to tow the vehicle with a tow truck or other vehicle until it is moved to a place where proper traction can be obtained for the driving wheels.

Separate, electric-powered winches are available for motor vehicles and these are frequently employed in off-road or four-wheel drive vehicles. Such separate winches, however, are cumbersome and unsightly in appearance. In addition, they are expensive and require special installation on the vehicle.

Other attempts have been made in the past of utilizing permanently attached winch drums attached to the driving wheels of the vehicle. These interfere with the operation of the vehicle in rocky or rugged terrain or even in parking the vehicle adjacent the curbs commonly employed along the edges of streets. When such fixed winch drums strike a rock or a curb they are easily damaged and impart unnatural stresses to the driving wheel components to which they are attached.

Other attempts in the past have been made to employ removable wheel winch drums. Some of these utilize a permanently attached adapter which is held in place by the wheel lug bolts used to attach the vehicle wheel to the axle. A second part then is employed to complete the drum when it is desired to use it; but these multipart assemblies are relatively expensive, and the permanent attachment of a portion of the assembly to the vehicle wheel is not particularly desirable since it unnecessarily complicates the changing and rotation of tires on the vehicle. Other prior art one-piece winch drums are difficult to attach and remove because of interference of the outer flange with the use of a lug wrench.

It is desirable therefore to provide a simple winch drum construction for removable attachment to the wheel of the vehicle when the vehicle is stuck and it is necessary to use the winch to assist in removal of the vehicle to a place of positive traction. It is further desirable to construct a removable wheel winch in a manner which facilitates its easy attachment and removal from the vehicle wheel.

SUMMARY OF THE INVENTION

Accordingly, it is an object of this invention to provide an improved device for facilitating the movement of stuck motor vehicles.

It is another object of this invention to provide an improved wheel mounted winch for motor vehicles.

It is an additional object of this invention to provide an improved removable wheel winch for motor vehicles.

A further object of this invention is to provide a removable one-piece wheel winch for simple attachment to the driving wheel of a motor vehicle in which the winch is constructed to accommodate a wrench for tightening and loosening the wheel lug nuts to effect the attachment and removal of the wheel winch from the vehicle wheel.

In accordance with a preferred embodiment of this invention, a removable winch for mounting on the driving wheel wheel bolts is made of a one-piece drum having first and second spaced flanges on each end. The first flange has holes through it for receiving some of the wheel bolts on the wheel to which the winch is to be attached and has at least one other hole sufficiently large to permit passage to the wheel bolt nut through it. Corresponding holes which are at least in part longitudinally aligned with the holes in the first flange are made in the second flange, and these holes in the second flange are large enough to permit the passage of the head of a lug wrench through them. In the drum below the wheel bolt receiving holes are apertures for accommodating the head of the wrench, so that the winch may be readily attached to and removed from the driving wheel of a vehicle.

DETAILED DESCRIPTION OF THE PREFERRED EMBODIMENT

Figure 1:
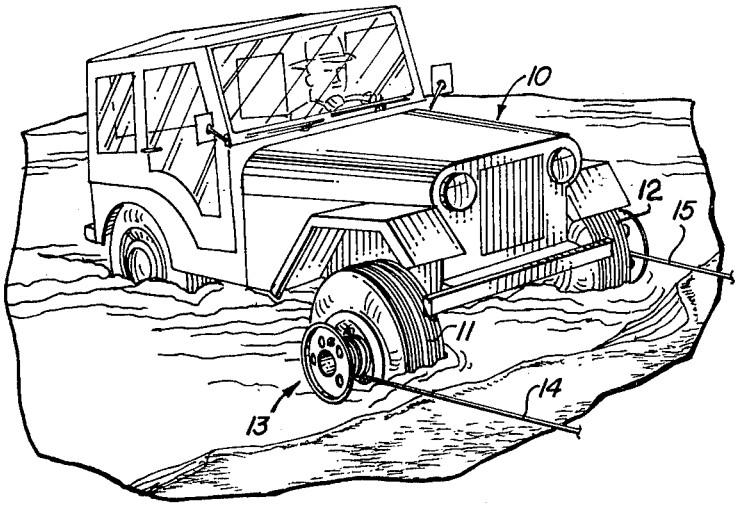
FIG. 1 illustrates a preferred embodiment of the invention shown as used on a motor vehicle.
Figure 6:
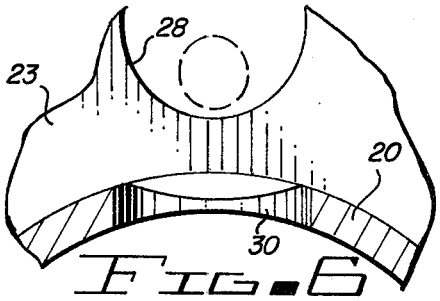
FIGS. 6 and 7 are partial cross-sectional cut-away views of details of the embodiment shown in FIGS. 2 and 5 taken along the lines 6—6 and 7—7, respectively, of FIG. 5.
Figure 7:
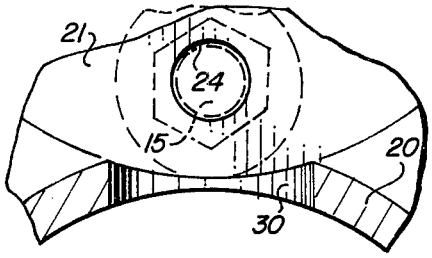

Referring now to the drawings, like reference numbers are used throughout the different FIGURES to designate the same or similar components.

In FIG. 1 there is shown a typical motor vehicle 10 with which the preferred embodiment of the invention may be used. The vehicle 10 illustrated is a four-wheel drive vehicle, but it is to be understood that the invention is equally applicable to conventional two-wheel drive vehicles. As illustrated, the four-wheel drive vehicle 10 has a pair of front driving wheels 11 and 12, each of which is illustrated as having attached to it a wheel winch 13 used to wind cables 14 and 15 as the wheels 11 and 12 rotate; so that the vehicle 10 can be extracted from the mud, sand or snow in which it is stuck. If the vehicle 10 uses a positive traction or no-slip differential on either its front driving wheels or its back driving wheels, it is only necessary to attach a single wheel winch 13 to one of the driving wheels since such a differential applies the driving power to the vehicle wheel which does not slip. On the other hand, if such a no-slip differential is not employed, wheel winches 13 must be employed on both driving wheels on the same axle to insure removal of the vehicle.

Figure 2:
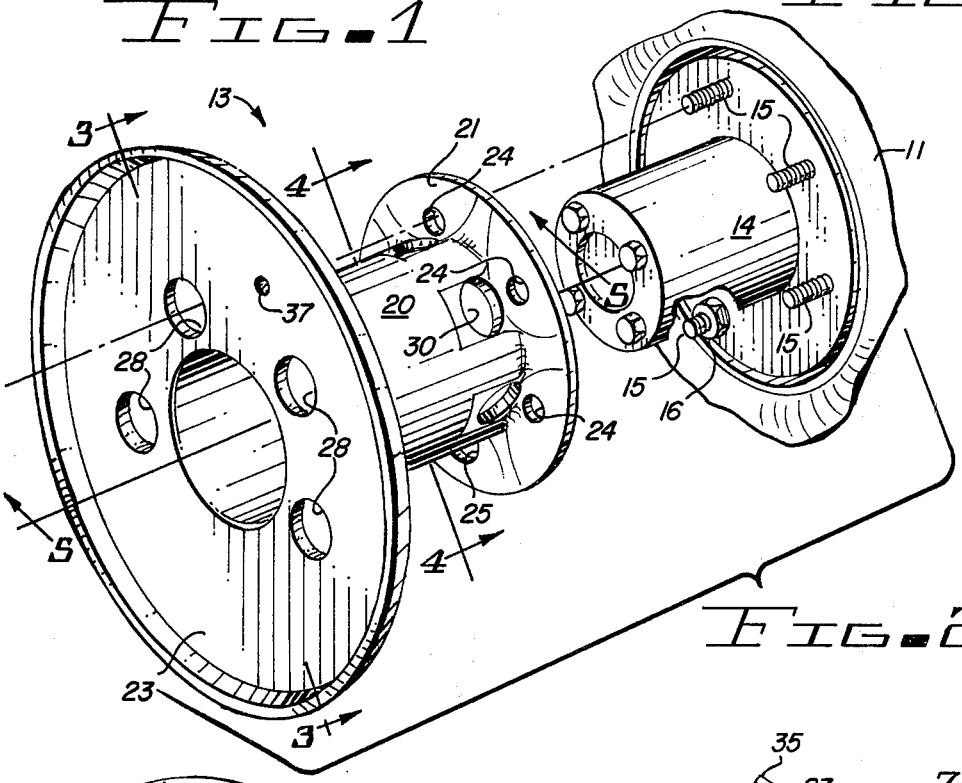
FIG. 2 is a perspective view of a preferred embodiment of the invention illustrating the manner of attachment to the wheel of a vehicle.
Figure 3:
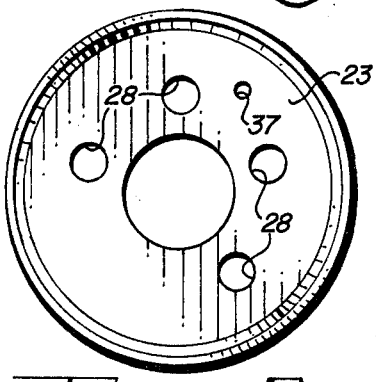
FIGS. 3 and 4 are detailed views of portions of the embodiment shown in FIG. 2.
Figure 4:
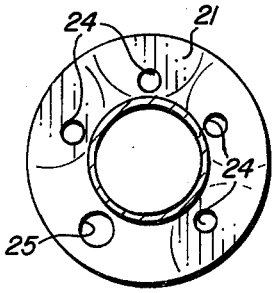

FIG. 2 illustrates the details of the wheel winch 13 and the manner of attachment of the wheel winch to the wheel bolts or lug bolts conventionally employed to mount a vehicle wheel 13 onto the end of the axle support. As illustrated in FIG. 2, the wheel 13 has an extending hub 14 of the type which is commonly encountered in four-wheel drive vehicles. Spaced around the periphery of the hub 14 are the wheel bolts or lugs 15, three of which are shown without a securing nut on them and the fourth of which is shown with a securing nut 16 in place. When the wheel is attached to the vehicle, nuts 16 are tightened on all of the bolts 15 in a conventional manner. Some vehicles use a combined nut and bolt which is completely removed from the axle support and which threadedly engages the support. This alternative is to be considered as equivalent to the construction shown in FIG. 2 since both types of wheel bolts or wheel lugs are in common use.

When the vehicle becomes stuck and it is desired to use one or more wheel winches 13 to effect removal of the vehicle from the material in which it is stuck, all but one of the nuts 16 on the five wheel bolts 15 illustrated on the wheel in FIG. 2 are removed. This is the condition which is illustrated in FIG. 2. Once this has been accomplished, a wheel winch 13, constructed with a hollow drum member 20 and having an inner flange 21 at one end and a larger outer flange 23 at the other end, is slipped over the hub 14 to cause four wheel bolt receiving holes 24 to be slipped over the wheel bolts 15 which have had the nuts 16 removed from them. A fifth hole 25 formed in the flange 21 is an enlarged hole and it passes over the nut 16 and wheel bolt 15 from which the nut has not been removed. The reason for this one enlarged opening is to permit one nut 16 to be engaged to hold the vehicles wheel in place when the wheel winch 13 is placed on and subsequently secured to the wheel. The hollow drum member 20 permits access to the locking hub 14 through the winch 13 when it is secured to the wheel.

After the wheel winch 13 is slipped over the wheel bolts 15 as described above, the nuts 16, for the four wheel bolts 15 from which the nuts had been removed, are then tightened in place to hold the flange 21 of the wheel winch 13 tightly against the wheel. In turn, the wheel also is tightly remounted on the axle support to which it normally is attached. The tightening of the bolts 16 is effected by extending an elongated lug wrench (shown in dotted lines in FIG. 5) through four holes 28 at least a portion of each of which are longitudinally aligned with the four wheel bolt holes 24 in the flange 21. It should be noted that the area of the flange 23 which is longitudinally aligned with the wheel bolt 15 from which the nut 16 was not removed has no hole in it since there is no necessity to obtain access to the nut 16 for that wheel bolt. The diameter of the apertures 28 in the flange 23 is larger than the diameter of the apertures 24 and is sufficiently large to freely permit the passage of the head of the lug wrench through these holes to engage the nuts 16.

Because of the relatively close proximity of the nuts 16 to the drum 20 of the wheel winch 13 when it is slipped over the wheel bolts 15, recesses in the form of holes 30 are formed through the drum portion 20 directly beneath each of the holes 24 to accommodate the head of the lug wrench when it is used to turn the nuts 16 on the wheel bolts 15. This is necessary because of the thickness of the drum 20 which substantially reduces the normal clearance between the wheel bolts 15 and the hub 14. Without this relief provided by the recesses in the form of the holes 30, it would be difficult, and in some cases impossible, to use a conventional lug wrench head to attach the nuts 16 to the wheel bolts 15. Although the holes 30 are shown as round holes, the particular shape which is illustrated is not critical, and rectangular holes or holes of other shapes could be employed equally as well, so long as they serve the purpose of providing the necessary clearance for the head of the lug wrench. This relationship is illustrated most clearly in the cut-away view of FIG. 5.

Figure 5:
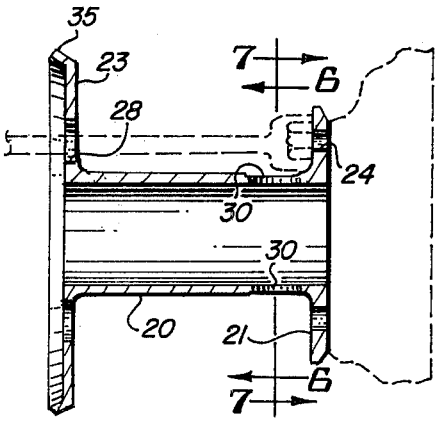
FIG. 5 is a cross-sectional view taken along the line 5—5 of the embodiment shown in FIG. 2.

The outer flange 23 has its outer edge 35 beveled or turned outwardly, as illustrated most clearly in FIGS. 2 and 5, to provide a surface which slopes inwardly toward the drum 20. The outer edge of the flange 21 also may be provided to accommodate the corresponding external surface configuration of the vehicle wheel with which the wheel winch is to be used. For different vehicles, the external configuration of the flange 21 may vary in accordance with wheel variations, but generally a slight taper on the outer edge of the flange 21 is sufficient for most applications.

In the operation of the wheel winch, after it is attached to a vehicle wheel as described above, a cable is attached to a hole 37 formed through the outer flange 23. Alternatively, the cable could be attached to a hole in the drum portion 20 or to any one of the holes 28 or 30 in the flange 23 in the drum 20, respectively. In the case of a vehicle with no-slip differential, the other end of the cable 14 or 15 then is secured to a solid anchor such as another vehicle, tree, rock or the like and the vehicle is placed in its lowest gear and slowly operated to wind the cable 14 onto the wheel winch 13 and to pull the vehicle out of the material in which it is stuck.

If the vehicle does not have a no-slip differential a pair of wheel winch devices 13 must be attached to the driving wheels on opposite sides of the same axle as explained previously. When a vehicle of this type is used, it has been found most convenient to employ a pair of steel cables, one of which is wrapped around the tree, boulder or other anchor. Both ends of this first cable preferably are terminated in a steel ring. The second cable then is hooked to the hole 37 in one of the wheel winches, the other end is passed through the two rings on the first cable and is returned to attach to the hole 37 in the other wheel winch 13 on the opposite side of the vehicle. Then when the wheels of the vehicle turn to wind up the cables, the single cable which is attached to both wheel winches, is permitted to slide one way or the other through the rings on the first cable to compensate for any uneven pull on the two wheel winches and equate the winding of the cable on the wheel winches. Of course, two separate cables 14 and 15 terminated in two separate anchors could be used if desired; but because of the uneven pull on the two different wheels it is possible to obtain kinks and loops in one or both of the cables as they are wound about their respective drum portions 20 of the wheel winches 13. For this reason it is desirableto use a single cable attached in a loop fashion as described above to both of the wheel winches 13 on both wheels of the vehicle.

Typical specifications of the wheel winch and the cables used with it are the use of ¼" thick hardened steel for the drum 20 and the flanges 21 and 23. The drum 20 has a 4 ¼" inner diameter and is 9" long. The flange 21 has an 8" diameter and the flange 23 has an 11" diameter. Typical cables are 3/16" stranded steel rated at 2,400 pound tensile strength.

The foregoing description taken in conjunction with the embodiments shown in the various FIGURES of the drawings is considered illustrative and is not intended in any way to be limting of the features of the invention. Various modifications may be made by those skilled in the art to the embodiment shown without departing from the true scope of the invention which has been illustrated in conjunction with the preferred embodiment.

I claim:

1. A winch for mounting on a driving wheel attached to a vehicle axle by a plurality of wheel bolts, said winch including in combination:

a drum member having only first and second spaced flanges thereon for receiving therebetween a cable to be wound on said drum member; said first flange thereof having wheel bolt receiving holes therethrough for receiving at least some of said plurality of wheel bolts and having at least one enlarged hole therethrough for permitting the passage of a wheel bolt nut therethrough; said second flange has holes therethrough aligned with said wheel bolt receiving holes; and said drum member having recesses therein adjacent said at least some of said wheel bolt receiving holes, but separated therefrom by solid portions of said first flange, to accommodate the head of a wrench.

2. The combination according to claim 1 wherein the holes formed through said second flange are at least in part longitudinally aligned with said wheel bolt receiving holes in said first flange, said holes in said second flange being dimensioned to permit the passage of the head of a wheel bolt wrench therethrough.

3. The combination according to claim 2 further including means on said second flange for attaching a cable thereto.

4. The combination according to claim 2 wherein said second flange has a solid surface in longitudinal alignment with said at least one enlarged hole in said first flange.

5. The combination according to claim 1 wherein said first and second spaced flanges are integral with said drum member and said second flange has a greater diameter than said first flange.

6. The combination according to claim 5 wherein said drum member is a hollow cylindrical drum member having an internal dimension large enough to accommodate a protruding hub of the wheel of the vehicle and to permit access therethrough to said hub.

7. The combination according to claim 6 wherein the holes in said second flange are wrench receiving holes formed therethrough and in longitudinal alignment with each of said wheel bolt receiving holes in said first flange for permitting access of the head of a wheel bolt wrench through said second flange to wheel bolts extending through the wheel bolt receiving holes of said first flange to permit attachment and removal of the winch from the driving wheel of the vehicle.

8. The combination according to claim 7 further including means on said second flange for attaching a cable thereto.

9. The combination according to claim 8 wherein the recesses in said drum member adjacent each of said wheel bolt receiving holes comprise apertures formed through said drum member.

10. The combination according to claim 9 wherein the outer surface of said first flange is shaped at least in part to matingly engage corresponding surfaces on the driving wheel to facilitate alignment of the winch with such driving wheel.

* * * * *